US007207454B2

(12) United States Patent
Chantalat

(10) Patent No.: US 7,207,454 B2
(45) Date of Patent: Apr. 24, 2007

(54) METHOD AND APPARATUS FOR SEALING AND RE-SEALING AN ANNULAR VESSEL OPENING

(76) Inventor: Vinit Chantalat, 11681 Dawson Dr., Los Altos Hills, CA (US) 94024

( * ) Notice: Subject to any disclaimer, the term of this patent is extended or adjusted under 35 U.S.C. 154(b) by 0 days.

(21) Appl. No.: 10/802,896

(22) Filed: Mar. 16, 2004

(65) Prior Publication Data

US 2005/0092707 A1 May 5, 2005

Related U.S. Application Data

(63) Continuation-in-part of application No. 10/697,061, filed on Oct. 29, 2003, now Pat. No. 6,832,634.

(51) Int. Cl.
*B65D 51/16* (2006.01)

(52) U.S. Cl. ..... 215/360; 220/235

(58) Field of Classification Search ..... 215/358–362; 220/233–238; 138/90

See application file for complete search history.

(56) References Cited

U.S. PATENT DOCUMENTS

| | | | | | |
|---|---|---|---|---|---|
| 251,047 | A * | 12/1881 | Hand | 215/360 |
| 456,257 | A * | 7/1891 | Haigh | 215/360 |
| 2,062,519 | A * | 12/1936 | Ljungberg | 138/90 |
| 2,292,726 | A * | 8/1942 | Trippensee | 215/307 |
| 3,937,350 | A | 2/1976 | Volker | |
| 4,076,142 | A | 2/1978 | Naz | |
| 4,175,668 | A | 11/1979 | Hebert | |
| 4,440,309 | A * | 4/1984 | Morimoto | 220/235 |
| 4,534,482 | A | 8/1985 | Boucle | |
| 4,842,151 | A | 6/1989 | Scott | |
| 5,056,676 | A | 10/1991 | Allen et al. | |
| 5,117,995 | A | 6/1992 | Kau | |
| 5,307,841 | A * | 5/1994 | Condon | 138/90 |
| 5,947,310 | A | 9/1999 | Wagner | |
| 5,975,322 | A | 11/1999 | Reid | |
| 6,607,087 | B2 * | 8/2003 | Turnwald | 215/360 |
| 2003/0141272 | A1 * | 7/2003 | De La Cruz | 215/360 |
| 2003/0168424 | A1 * | 9/2003 | Permuy | 215/360 |

* cited by examiner

*Primary Examiner*—Lien M. Ngo
(74) *Attorney, Agent, or Firm*—David R. Boys; Central Coast Patent Agency, Inc

(57) ABSTRACT

A stopper assembly for sealing an opening of a vessel has a threaded body having a tapered head; an elastic jacket fitted over a portion of the body; a retention housing fitted over the body and jacket, the retention housing retaining the jacket from lateral displacement there through; and a turning nut attached to the retention housing and threaded to the body. A user inserts the stopper assembly into the vessel opening, holds the retention housing stable, and turns the turning nut causing travel of the threaded body through the retention housing and deformation of the elastic jacket against the tapered head, deformation thereof directed radially outward to make peripheral contact with the inner surface of the opening affecting a seal of the opening.

11 Claims, 10 Drawing Sheets

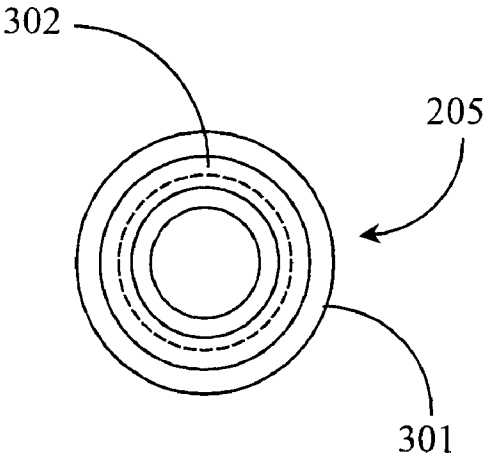
Fig. 3B
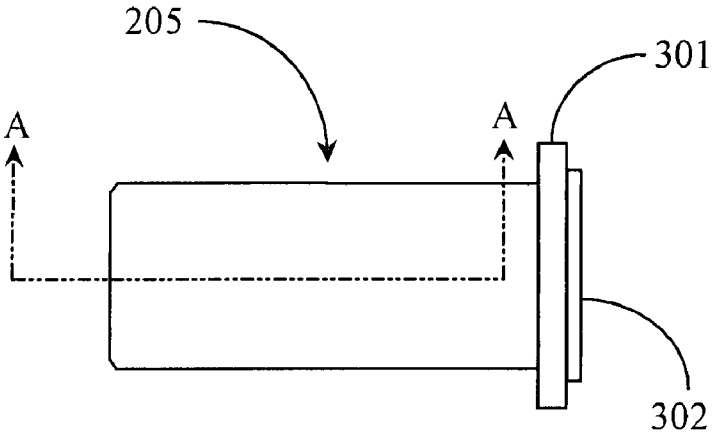
Fig. 3A
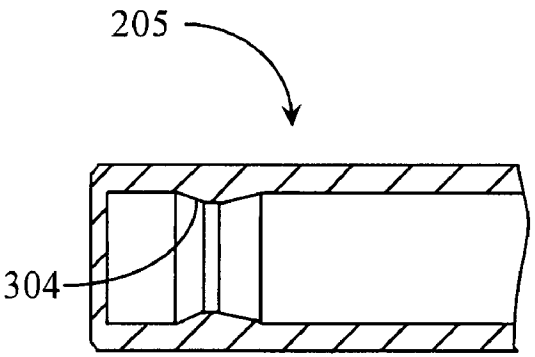
Fig. 3C section AA

METHOD AND APPARATUS FOR SEALING AND RE-SEALING AN ANNULAR VESSEL OPENING

CROSS-REFERENCE TO RELATED DOCUMENTS

The present application is a continuation-in-part of application U.S. Ser. No. 10/697,061 filed Oct. 29, 2003 now U.S. Pat. No. 6,832,634, included herein in its entirety by reference.

FIELD OF THE INVENTION

The present invention is in the field of sealing mechanisms and pertains particularly to methods and apparatus for sealing and or re-sealing annular openings of containers, vessels, and delivery systems having nozzle-type annular openings.

BACKGROUND OF THE INVENTION

In the art of airtight sealing there are a variety of sealing mechanisms that are available for resealing a vessel opening, typically a bottle neck, that previously been opened. A very common example in the prior-art of record is re-sealing a Champaign bottle or other bottle type adapted to contain pressurized and non-pressurized liquids.

The inventor is aware of a stopper device referenced herein by U.S. Pat. No. 3,937,350, which comprises a cap or hood, an elongated rubber sleeve, and a connecting rod or piston rigidly affixed to the cap or hood, the rod supporting the rubber sleeve. This stopper is pressed into a bottle to stretch the sleeve via the connecting rod to fill the annular gap between the rod and inner wall of a bottle opening to be stopped.

A drawback with this kind of device is that it is not adjustable in terms of seal strength and must be manufactured for a specific size bottle opening. Many conventional stoppers are of the just-described type and have many limitations related to use-ability and convenience in manufacturing.

The inventor is aware of another type of stopper device referenced herein as an example of this type by U.S. Pat. No. 4,175,668, which comprises a cap having articulated jaws or straps designed to engage the bottle neck below a lipped portion thereof using the lip feature of the bottle neck to leverage closure and sealing with a cork stopper portion of the apparatus. This type of device utilizes leverage via manually clamping and unclamping of the jaws to apply leverage to depress a cork into the bottle opening. A limitation of this device is that it requires a bottle opening to have a lip to which the apparatus must be dimensionally adapted. Moreover, such mechanically dependent parts often bend break or otherwise lose usefulness with improper or even repeated use. Another U.S. patent that describes a variation of a lip-dependant stopper is referenced herein as U.S. Pat. No. 4,534,482. The same types of limitations apply.

The inventor is also aware of a stopper coupled with an air injection mechanism referenced herein as U.S. Pat. No. 4,842,151, which comprises a closure assembly, a female disconnect joint and an air pumping unit. In a variation of lever-actuated stoppers, a cam lever is leveraged to force compression to an inserted seal plug to expand the plug outwardly thereby sealing the bottle. A one-way air passage extending through the assembly into the interior portion of the bottle is used to introduce air into the bottle after sealing to maintain internal pressure, hence maintaining carbonation therein. The device has the same limitations as the lever actuated sealing device described further above with respect to fragile and obstructive moving parts and must be forcibly held down against the bottle before sealing can be affected.

Prior-art forming of bottles in general and specifically Champaign and wine bottles include lips, tapers, and other forms to which prior-art stopper devices must be adapted. Persuasively, the prior-art stoppers mentioned above are limited in application to specific implementations of consumer bottles of pre-known shapes, sizes and dimensions.

What is clearly needed in the art is an adjustable and axially activated stopper assembly that can be implemented without lever and with minimum force or work and that does not depend on any feature of a bottle opening to engage successfully.

SUMMARY OF THE INVENTION

In a preferred embodiment of the present invention a stopper assembly for sealing an opening of a vessel is provided, comprising a screw stem body having a tapered head, an elastic element fitted over a portion of the screw stem body, a retention housing fitted over the screw stem body and jacket, the retention housing retaining the jacket from lateral displacement there through, and a turning nut attached to the retention housing and threaded to the screw stem body. The assembly is characterized in that a user inserts the stopper assembly into a vessel opening, holds the retention housing stable, and turns the turning nut causing travel of the screw stem body through the retention housing and deformation of the elastic element against the tapered head, deformation thereof directed radially outward to make peripheral contact with the inner surface of the opening affecting a seal of the opening.

In one embodiment the elastic element is a rubber sleeve having a flared end and deformation occurs when the tapered surface of the tapered head is forced against the flared portion of the sleeve. In another embodiment the elastic element is a rubber socket covering the tapered head, the socket having a formed feature of peripheral orientation in the socket wall and deformation occurs when the tapered surface of the tapered head is forced against the formed feature of the socket. In another embodiment the retention housing is keyed to the threaded portion of the body using a key held in a key opening on the housing, the key engaging a key slot in the body to prevent rotation of the housing about the body. In some embodiments the retention housing includes a retention cap and a gripping cup the cup gripping the inner surface of the retention cap to prevent inter-rotation of the components.

In another embodiment of the invention there is further a gas passageway extending longitudinally through the screw stem body, a second threaded portion on the body, and a valve stem assembly threaded onto the second threaded portion. In this embodiment gas is inserted into the vessel by way of the valve stem assembly and passageway through the sealed opening to maintain carbonation of liquid held in the vessel.

In some embodiments the retention housing is keyed to the threaded portion of the screw stem body using a key engaging a key slot in the body to prevent rotation of the housing about the body. Also in some embodiments the retention housing includes a retention cap and a gripping cup the gripping cup gripping the inner surface of the retention cap to prevent inter-rotation of the components.

In another aspect of the invention a method is provided for sealing a vessel opening using a stopper assembly having a screw stem body with a tapered head, an elastic element fitted over a portion of the body, a retention housing fitted over the body and jacket; and a turning nut attached to the retention housing and threaded to the screw stem body. The method comprises steps of (a) positioning the stopper assembly into the vessel opening; (b) holding the retention housing to stabilize body travel there through; and (c) turning the turning nut until the opening is sealed.

In some embodiments of the method the elastic element is one of a rubber sleeve or a rubber socket. Also in some embodiments, in step (a) the vessel opening and is void of threading or lip features. Also in some embodiments in step (b) the retention housing retains the elastic element and functions as a travel bed for the threaded body portion. Still in some other embodiments in step (c) the amount of turning of the turning nut is constrained by a stop nut engaged on a second threaded portion of the screw stem body.

BRIEF DESCRIPTION OF THE DRAWING FIGURES

FIG. 3A is an elevation view of a rubber stopper used with screw stem 200 of FIG. 2A.

FIG. 3B is a right-end view of the stopper of FIG. 3A.

FIG. 3C is a cut-view of the stopper of FIG. 3A taken generally along the cut lines AA.

DESCRIPTION OF THE PREFERRED EMBODIMENTS

Figure 1:
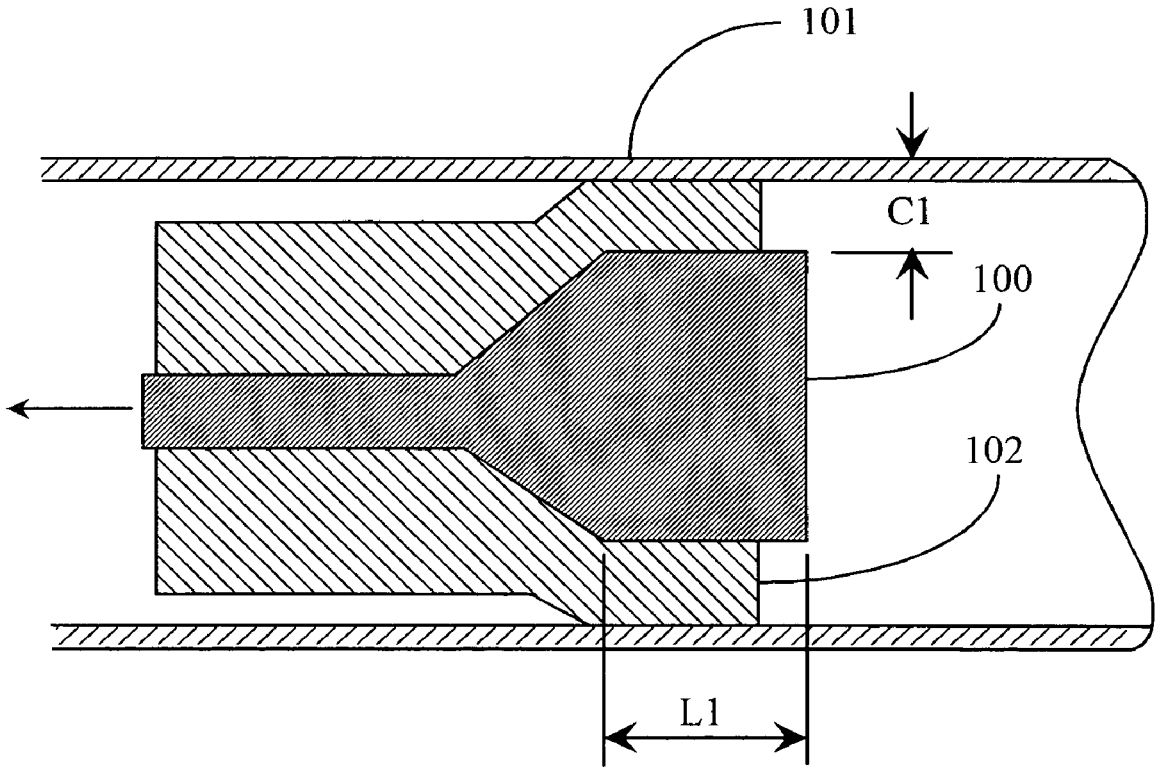
FIG. 1 is a block diagram illustrating a sealing principle applied by a device of the present invention in an annular opening of a vessel according to an embodiment of the present invention.

FIG. 1 is a block diagram illustrating a sealing principle applied by a device of the present invention in an annular opening of a vessel according to an embodiment of the present invention. As was described with respect to the background section of this specification, prior-art sealing methods for sealing an annular opening of a bottle or vessel are limited by mechanical frailty and stringent dimensional concerns. A device for sealing annular openings according to an embodiment of the present invention, also termed herein a stopper assembly by the inventor, uses a rubber sleeve or, in some variations, a rubber socket 102, to form a peripheral seal around the inner wall of a vessel opening 101, such as a bottle neck. To affect a strong seal, a principle of forced flare-out of the sleeve is practiced using an axially motivated tapered stem 100.

Sleeve 102 is an elastic rubber-like material that is pliable under force but reverts to its natural and original shape in the absence of interacting force. Sleeve 102 in a particular embodiment has an inner wall provided of a size to accept tapered head portion 100 of a rigid screw stem. A portion of sleeve 102 on the end interfacing with tapered head portion 100 may be tapered or flared out around the inside wall with the tapered section substantially aligning in angle with the tapered angle of head 100. Head 100 is, in a preferred embodiment, manufactured of a brass material or other relatively soft metal. Other rigid materials may also be used to manufacture head 100. For example hard plastic materials like polycarbonate, polyoxymethylene (POM), or acetal materials, all of which may be molded.

As illustrated in the exemplary diagram, head 100 is inserted into the tapered end of rubber sleeve 102 while positioned longitudinally within annular opening 101 and is further urged therein axially in the direction of the arrow such that the tapered land area of head 100 makes intimate contact with the tapered section of sleeve 102 and forces an expansion of rubber material radially outwardly toward the inner wall of opening 101. As rubber material under force expands past the tapered wall portion of head 100, it fills in a peripheral clearance space provided between the outer diameter of tapered head 100 and the inner diameter of opening 101.

In preferred embodiments the clearance space C1 between the inside wall of the neck or opening 101 (to be sealed) and the greater-diameter straight portion of tapered head 100 is kept at a minimum to prevent flow of material when the rubber-like material of sleeve 102 is compressed by the tapered portion, so that the rubber-like material may strongly seal the clearance space. Further, the length L1 of the greater-diameter portion of tapered head 100 should be greater than 3/16 inch to prevent overflow of the rubber-like material when compressed.

The expanding rubber covers the outside diameter of head 100 with sufficient force and is thereby forcibly compressed against the inner wall of opening 101 thus sealing the opening. The amount of force applied, together with the characteristics of the elastic material, determines the strength of the seal. Upon retraction of force in the reverse direction after sealing, tapered head 100 is retracted from sleeve 102 and the expanded rubber of sleeve 102 retracts to its original form and diameter, breaking the seal.

Figure 7A:
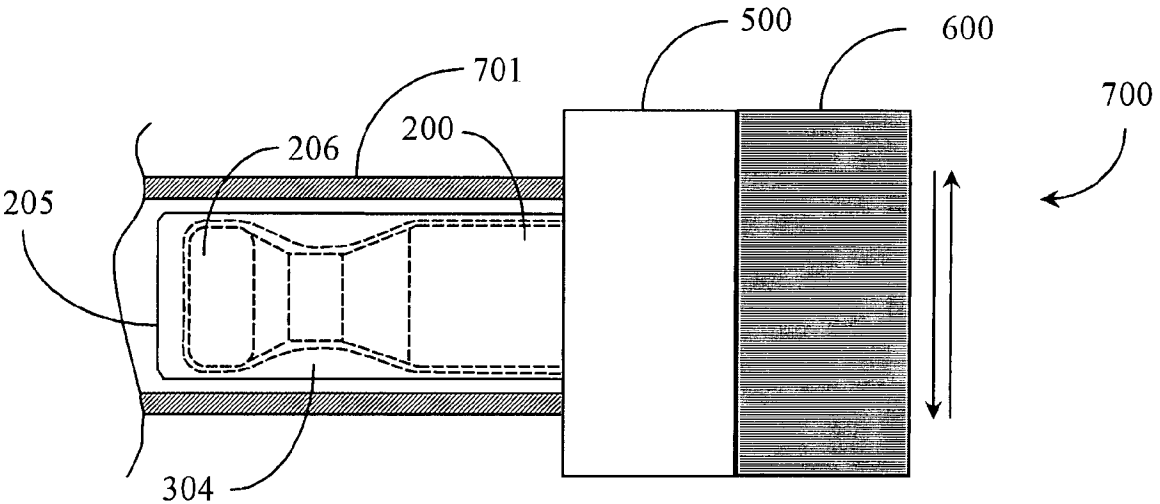
FIG. 7A is an elevation view of a stopper assembly encompassing the components illustrated in FIGS. 2A through 6B inserted into an annular opening.
Figure 7B:
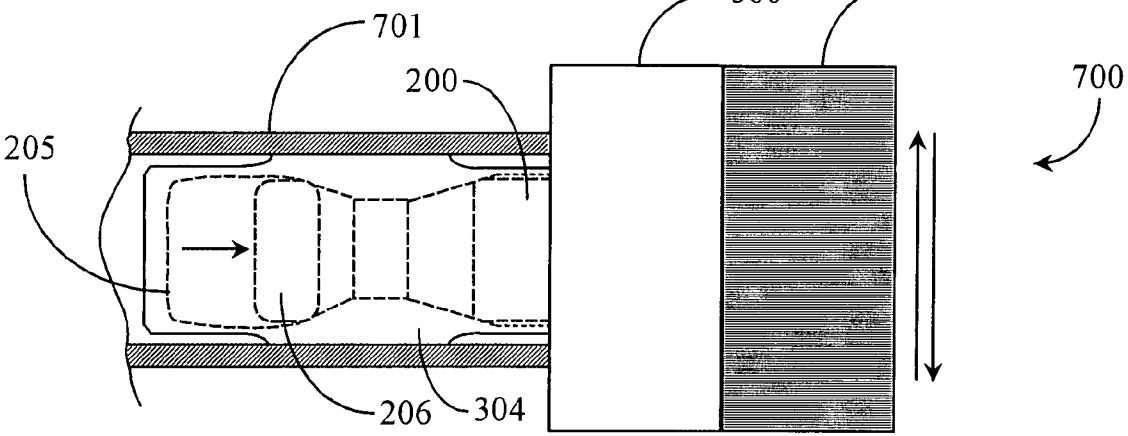
FIG. 7B is an elevation view of the stopper assembly of FIG. 7A actuated to seal the opening.

In a preferred embodiment of the invention, the described principle is implemented using a mechanically simple device or stopper assembly that requires little applied force to affect a seal and little applied force to disengage the seal from the opening of a vessel. FIGS. 7A and 7B illustrate an assembled device and function of the components detailed below in various embodiments.

Figure 2A:
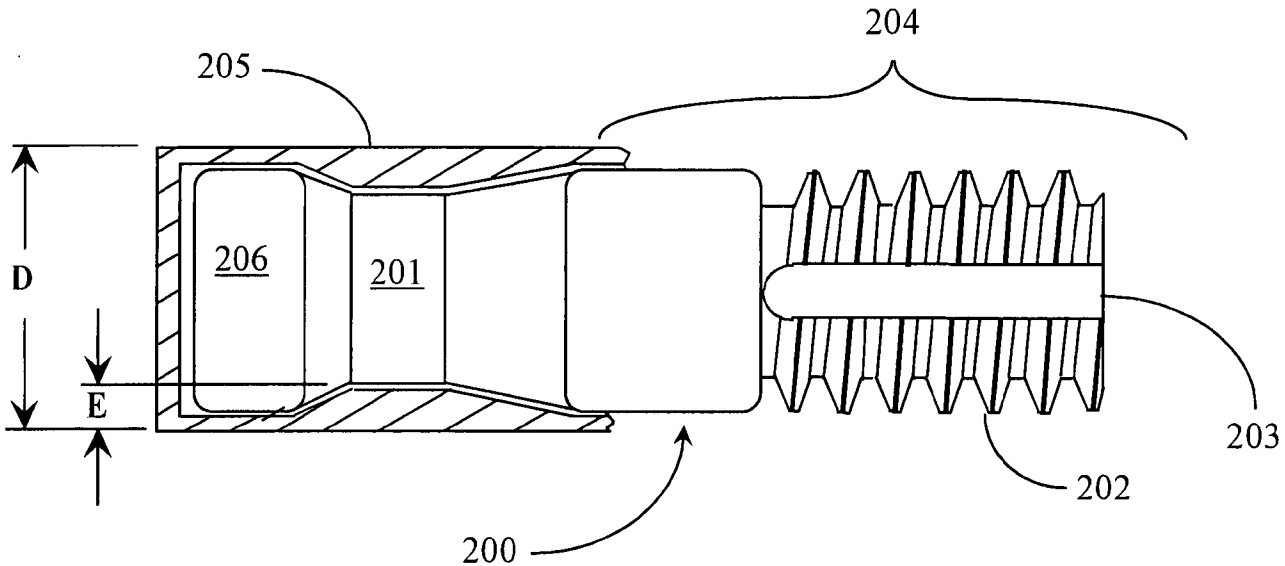
FIG. 2A is an elevation view of a screw stem of a stopper assembly according to one embodiment of the invention.
Figure 2B:
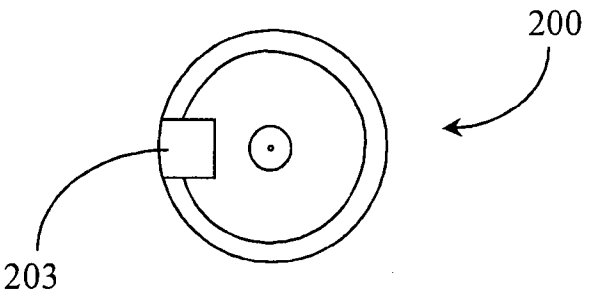
FIG. 2B is a right-end view of the screw stem of FIG. 2A.

FIG. 2A is an elevation view of a screw stem 200 of a stopper assembly according to one embodiment of the invention. FIG. 2B is a right-end view of the screw stem of FIG. 2A.

Referring now to FIG. 2A, screw stem 200 is a core component of a device used with a closed rubber-like socket 205 for mechanically sealing and unsealing an annular opening according to one embodiment of the present invention. Screw stem 200 includes a tapered head portion 206, which tapers down to form a neck or waist 201. Stem 200 is used with a closed rubber-like socket 205 instead of a sleeve as described with respect to the example of FIG. 1 above.

Neck 201 tapers outward to a screw stem body section 204 having a threaded portion 202 provided to engage a turning nut, which will later be described. Neck 201 provides a waist section between head 206 and stem body section 204 for retaining rubber-like socket 205.

Threaded section 202 of screw stem body section 204 has a key slot 203 formed in a longitudinal direction, the slot of substantial depth to equal or slightly exceed the depth of threads 202 and of a length to span the length of threaded section 202. The purpose of slot 203 is to retain a key that also engages a retention housing assembly 409 enabling turning of screw stem 200 to cause travel of the stem through the retention housing assembly, which is described in detail below.

Movement of stem 200 longitudinally within rubber-like socket 205 compresses material of socket 205 outward, just as described above with reference to FIG. 1. The unexpanded diameter is D, and the maximum expanded diameter is D+2E.

Referring now to FIG. 2B, in this embodiment screw stem 200 is solid and is manufactured of a brass material, or other soft and easily worked metal, or may be made of a plastic material, such as polycarbonate, polyoxymethylene, or a polyacetal material, among others. Key-slot 203 is substantially rectangular in shape and accepts a key dimensionally adapted for the purpose.

FIG. 3A is an elevation view of rubber-like socket 205 used with screw stem 200 of FIG. 2A. FIG. 3B is a right-end view of socket 205. Referring now to FIG. 3A, socket 205 performs the same sealing function as does a rubber sleeve, however socket 205 is formed to fit completely over the end of screw stem 200 described with reference to FIG. 2A. Socket 205 completely encloses the tapered head portion and a significant body portion of the screw stem.

Socket 205 is made from a pliable, elastic rubber-like material. Further, socket 205 has a flange 301 formed on the end opposite the closed end. Flange 301 serves as a retention flange to be engaged by a retainer cap, which is part of a retention housing assembly 409 described further below. Socket 205 has a raised portion 302 in the form of a ring extending from the backside surface of flange 301. Ring 302 is substantially concentric with flange 301. Ring 302 fits into an annular groove of a gripper cup that along with the previously mentioned retainer cap forms a retention housing assembly 409 for retaining socket 205 in place and for enabling longitudinal travel of the underlying screw stem 200. Referring now to FIG. 3B, flange 301, annular raised portion 302 and the outer and inner walls of socket 205 are substantially concentric. The outermost diameter of socket 205 is smaller than the inner diameter of an annular opening meant to be sealed.

FIG. 3C is a cross-sectional-view of socket 205 of FIG. 3A taken generally along the section line A—A. Socket 205 is shaped to fit around screw stem 200. As such, socket 205 has an outer and inner diameter. In addition to flange 301, socket 205 has an internal feature 304 extending peripherally around the inside surface of socket 205 at a strategic location. Feature 304 is enables retention of socket 205 in a strategic position on screw stem 200 described with reference to FIG. 2A. More particularly, feature 304 has a shape similar to feature 201 of screw stem 200 and of slightly smaller size, to form a fit of the two opposing features when socket 205 is in place over stem 200. In this way, feature 304 presents a thicker wall that expands outwardly upon lateral displacement of the opposing feature on the screw stem. The tapered portion of both features align such that when screw stem 200 is caused to travel in a direction opposite the closed end of socket 205 the outer wall of socket 205 expands peripherally outward. More detail of function of the device of the present invention in various embodiments is provided below in this specification.

Figure 4B:
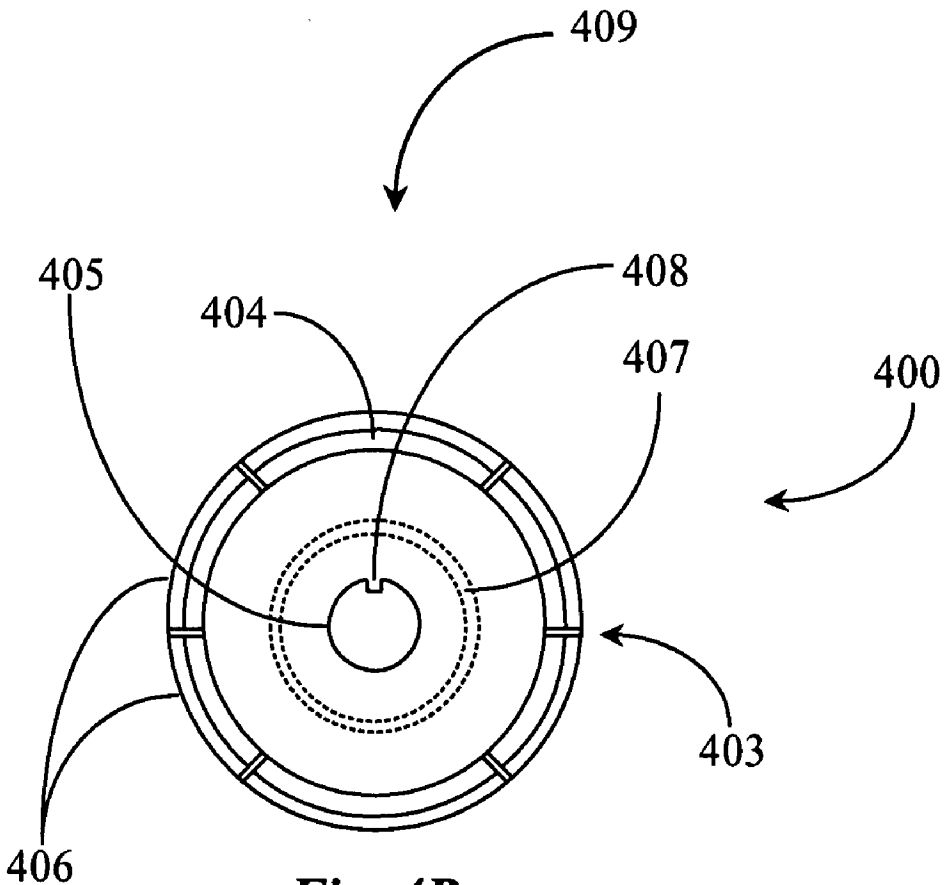
FIG. 4B is a facing view of the gripper cup of FIG. 4A.
Figure 4A:
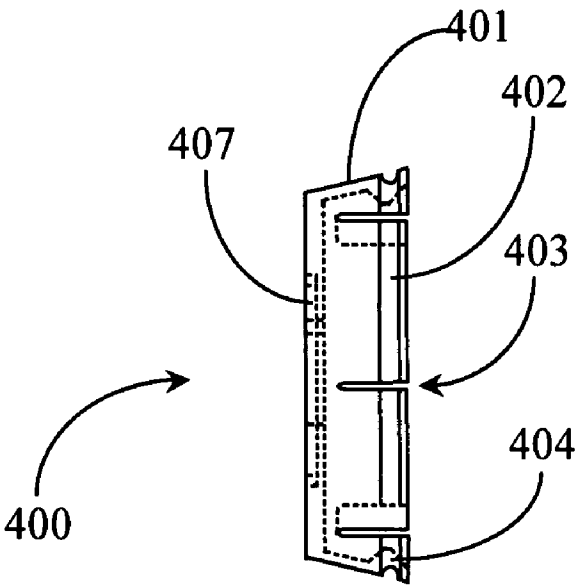
FIG. 4A is a left-side view of a gripper cup used in a stopper assembly according to an embodiment of the present invention.

FIG. 4A is a left-side view of a gripper cup 400 used in a stopper assembly according to an embodiment of the present invention. FIG. 4B is a face-on view of the gripper cup of FIG. 4A. Referring now to FIG. 4A, gripper cup 400 is adapted as part of a retainer housing assembly that includes the previously mentioned retainer cap. Gripper cup 400 is cup-shaped and annular in profile having a tapered wall that tapers down from a major diameter defining a top surface area to a minor diameter defining a bottom surface area of gripper cup 400. Gripper cup 400 is hollow on the inside to form an annular cup having an outer and inner diameter and an end wall. Gripper cup 400 is substantially open at its facing end.

Gripper cup 400 is, in a preferred embodiment, made from a durable and somewhat flexible polymer. An array of expansion slots 403 are substantially equally spaced in a peripheral array around and through the sidewall of gripper cup 400 to a specified depth. Expansion slots 403 are open on one end extending through the top surface of gripper cup 400. There are 6 expansion slots arrayed peripherally around the wall of gripper cup 400 in this example; however there may be more or fewer slots provided.

The array of, in this case, 6 slots 403 define a plurality of gripping teeth 406. A gripping tooth is a section of material bounded on each side by one expansion slot 403. The presence of slots 403 enable teeth 406 to expand outwardly around a hub of a turning nut described below.

Referring now to FIG. 4A, a groove 402 is provided peripherally in the outer surface of the sidewall of gripper cup 400 substantially near its open end. Groove 402 runs perpendicularly to expansion slots 403. Groove 402 is a retaining groove that snaps into place over an annular extension provided peripherally in the inner surface of a retaining cap illustrated with reference to FIG. 5A below.

Referring now to FIG. 4B, gripper cup 400 has an annular opening 405 through its end wall concentric with the outer diameter. A groove 407 is provided into the backside of the end wall of gripper cup 400 substantially centered with opening 405. Groove 407 has an outer and inner diameter and depth to retain annular raised portion 302 of socket 205 described with reference to FIG. 3A above, to prevent socket 205 from rotating about stem 200 (FIG. 2A) and to retard deformation of flange 301 of socket 205 when assembled and in use.

Opening 405 in this embodiment has a key element 408 formed inward from the diameter of the opening, as shown, that aligns with and engages key slot 203 of screw stem 200 in assembly, such that gripper cup 400 is prevented in assembly from rotating about screw stem 200. Gripper cup 400 has an annular raised region 404 provided peripherally around and on the inside surface of the sidewall at a location substantially opposing groove 402. Raised portion 404 is a retention element adapted to cause expansion of gripping teeth 406, further enabled by expansion slots 403, to provide a spring mechanism for enabling the previously described turning nut hub (FIG. 6A described below) to be pressed into place inside the gripper cup. Gripper cup 400 and the previously mentioned retainer cap (FIG. 5A described below) form the described retention housing assembly 409 for the purpose of retaining socket 205 in place over stem 200 and for providing a stable travel environment for screw stem 200, the travel controlled by the turning nut or knob.

Figure 5B:
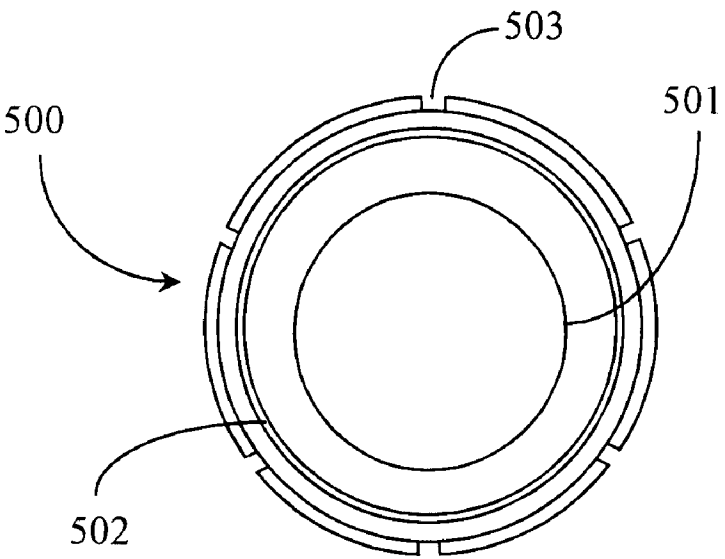
FIG. 5B is a facing view of the retainer cap of FIG. 5A.
Figure 5A:
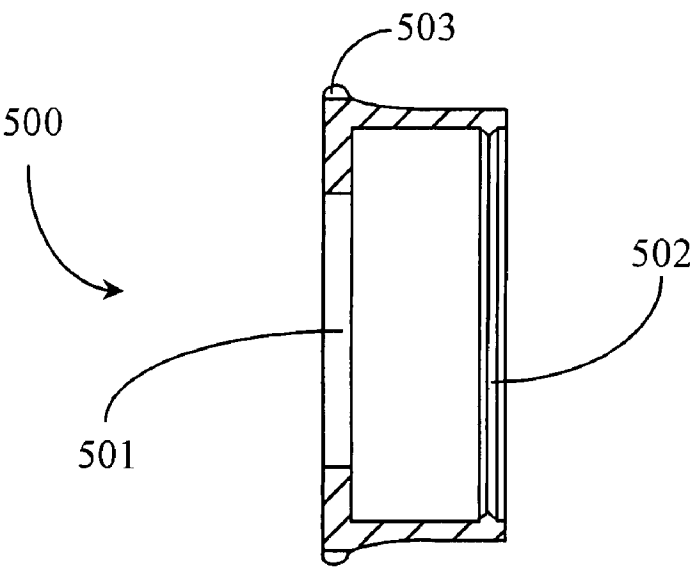
FIG. 5A is a left-side cut view taken vertically along the center axis of a retainer cap used with the stopper assembly of the present invention.

FIG. 5A is a left-side section view taken vertically along the center axis of a retainer cap 500 used with a stopper assembly according to an embodiment of the present invention. FIG. 5B is a face-on view of the retainer cap of FIG. 5A. Referring now to FIG. 5A, retainer cap 500 retains socket 205 described further above with reference to FIG. 3A onto gripper cup 400. Cap 500 is made in a preferred embodiment of a durable polymer as described above with respect to gripper cup 400. Cap 500 has an end wall, a sidewall and an open end. An opening 501 is provided through the end wall of cap 500. In addition, in a preferred embodiment, the outside shape of the cap is curved as shown, and a plurality of slots 503 are provided as shown for providing a non-slip grasp in operation of the assembly.

Opening 501 is substantially centered and concentric with the outer diameter of cap 500. Opening 501 has a diameter slightly larger than the diameter of rubber socket 205 described with reference to FIG. 3A, so that it may be placed over socket 205 in assembly. Placement is such that the inside surface of the end wall seats against the top surface of flange 301 of socket 205. Likewise, the inside diameter of cap 500 is slightly larger than the outside diameter of flange 301 of socket 205 to accommodate a snug fit.

Cap 500 has a peripheral raised region 502 around the inner sidewall surface near its open-end surface. Raised region 502 is of a size to snap into groove 402 of gripper cup 400 described with reference to FIG. 4A. Cap 500 and gripper cup 400 forms a retention housing and travel bed as previously described above. Referring now to FIG. 5B, raised portion 502 and opening 501 are substantially concentric with the outer diameter of cap 500. Retention cap 500 is placed in position over socket 205 and gripper cup 400 is snapped into retention cap 500 after the turning nut has been pressed into gripper cup 400. Retention cap 500 prevents gripper cup 400 from expanding and does not rotate around gripper cup 400 once snapped into place.

Figure 6B:
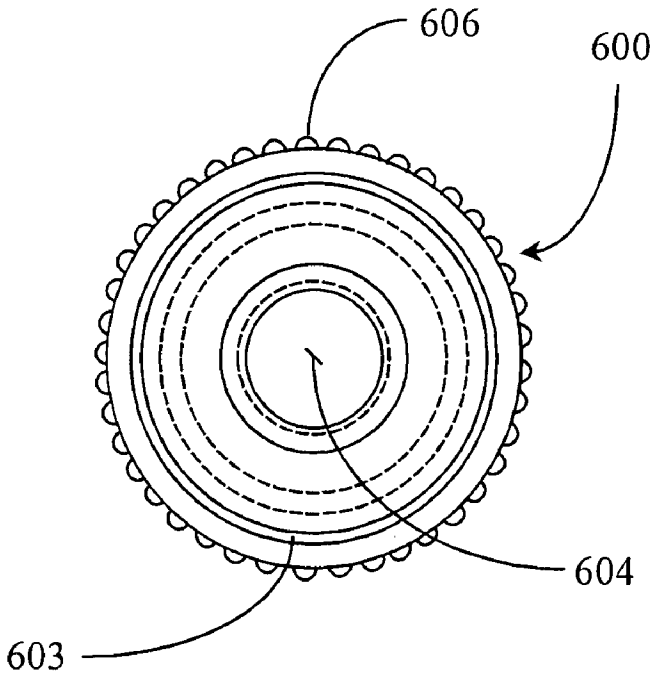
FIG. 6B is a facing view of the turning nut of FIG. 6A.
Figure 6A:
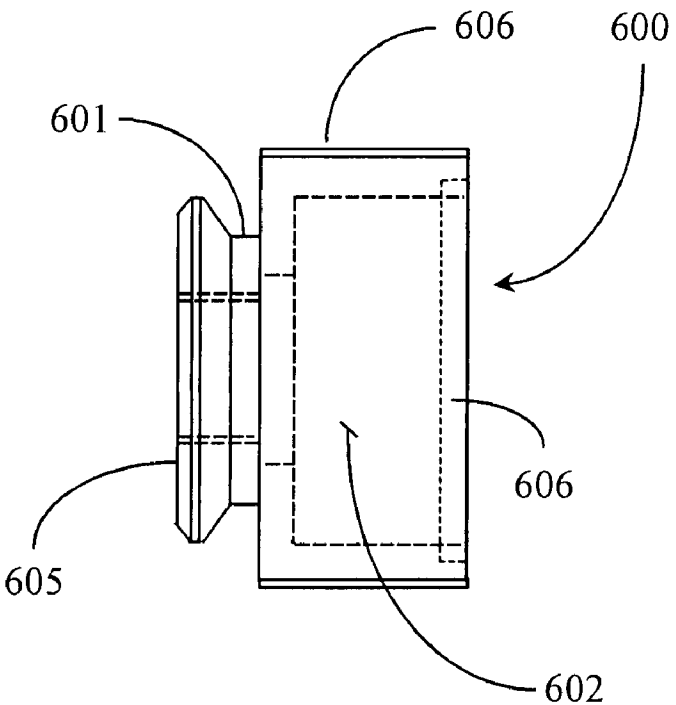
FIG. 6A is a left-side view of a turning nut used with the stopper assembly of the present invention.

FIG. 6A is a left-side view of a turning nut 600 used with the stopper assembly of the present invention. FIG. 6B is a face-on view of turning nut 600 of FIG. 6A. Referring now to FIG. 6A, turning nut 600 provides positive travel for screw stem 200 (FIG. 2A) through the keyed engagement between the gripper cup 400 and retention cap 500. Turning nut 600 is annular in profile and has an annular hub 605 extending therefrom. Hub 605 is centered and concentric with respect to the diameter of nut 600. A waist feature 601 is provided, the presence thereof defining hub 605. Hub 605 is pressed into place in assembly inside gripper cup 400 described with reference to FIG. 4A. When being pressed into place during assembly gripping teeth of gripper cup 400 expand outwardly enabled by expansion slots 403. The hub portion of turning nut 600 is retained by raised region 404 of gripper cup 400 locking the two components together. In many embodiments a groove 606 is provided at the open end of the turning nut to receive a snap-in cap to close the open end of the assembly.

Referring now to FIG. 6B, turning nut 600 has a threaded opening 604 provided therethrough, which is adapted to accept the threaded shank portion 202 of stem 200. Once threaded onto stem 200 engaging threads 203, the retention housing (gripper cup 400 and retainer cap 500) function as a keyed travel bed that does not rotate during travel of screw stem 200. Referring again to FIG. 6A, turning nut 600 has an outer surface 602 which is provided with friction features, such as longitudinal ridges 606 as shown, which function in this embodiment as a gripping surface for a user to leverage turning of nut 600. The features of the outside surface of turning nut 600 may vary appreciably from the ridges shown to aid in a gripping surface, ranging from no such features, to "other-than-circular" shape, such as oval, hexagonal, or square, to many sorts of gripping features or knurls. There are many possibilities.

Referring now to FIG. 6B, turning nut 600 is open-ended in this view. However, a lip 603 or counterbore is provided peripherally around the inside surface of the sidewall of nut 600 near its open-end surface and to a specified depth. Lip 603 in this embodiment is adapted to enable seating of an end cap or lid (not illustrated) that may be pressed thereon closing the open-end side of turning nut 600. In a preferred embodiment any lid provided would be re-openable allowing access for the purpose of disassembly or maintenance.

FIG. 7A is an elevation view of a stopper assembly 700 containing the components illustrated in FIGS. 2A through 6B inserted into a circular opening 701 of a vessel. FIG. 7B is an elevation view of assembly 700 of FIG. 7A actuated to seal opening 701. Referring now to FIG. 7A, stopper assembly 700 is illustrated in assembled form and inserted into opening 701 of a vessel to be sealed. In some embodiments the vessel is a bottle, however other types of vessels and some delivery systems having annular nozzles can be sealed using embodiments of the present invention.

This particular assembly 700 represents just one possible configuration of a stopper assembly according to an embodiment of the invention. For example, assembly 700 uses socket 205 and screw stem 200 previously described. This is termed by the inventor a closed-head stopper assembly because socket 205 completely covers screw stem 200. In this configuration the surface of stem 200 does not make contact with any liquid inside a vessel accessed through vessel opening 701.

Socket 205 is retained by cap 500 and internal gripper cup 400 (see FIG. 4) which is keyed to stem 200. Gripper cup 400 and cap 500 form a travel bed by virtue of semi-rigid assembly to each other via ring-and-groove engagement and by the keyed arrangement between gripper cup 400 and stem 200. In this way a user may hold the outside of cap 500 stationary and turn turning nut 600 clockwise or counter clockwise to cause stem 200 to travel longitudinally back or forth within stationary socket 205. As stem 200 is withdrawn feature 201 (see FIG. 2A) engages and deforms feature 304 to expand the outside diameter of socket 205 a seal in opening 701. In one embodiment, a stop nut can be provided at the threaded end of stem 200 so that turning nut 600 cannot be tightened so much that backing the nut off again is difficult.

The purpose of a stop nut is to prevent overturning back (turn out) of the screw stem in embodiments that use an open sleeve, as opposed to the closed-socket type 205. In the closed-head type using socket 205 the screw stem is contained in the socket, so there is no way of losing the stem when assembling the unit, or when turning back, so a stop nut is unnecessary. The stop nut is necessary in the open-ended type.

In the view of FIG. 7A the stopper assembly is inserted into opening 701 but not actuated to affect a seal. It is assumed that in this position turning nut 600 is turned counter clockwise into a home position that causes socket 205 to be fully relaxed. The outside diameter of socket 205 in a relaxed position is sufficiently smaller than the inside diameter of opening 701 to enable easy insertion into the opening or withdrawal from the opening.

Referring now to FIG. 7B, stopper assembly 700 is actuated by turning nut 600 to retract stem 200 into the assembly in the direction of 702 causing the tapered portion to be urged against feature 304 of socket 205. The applied force aided by the angle of taper expands material of socket 205 against the inner surface of opening 701. There is sufficient friction by design to prevent relaxation of the assembly unintentionally after a user releases the turning nut.

Figure 8A:
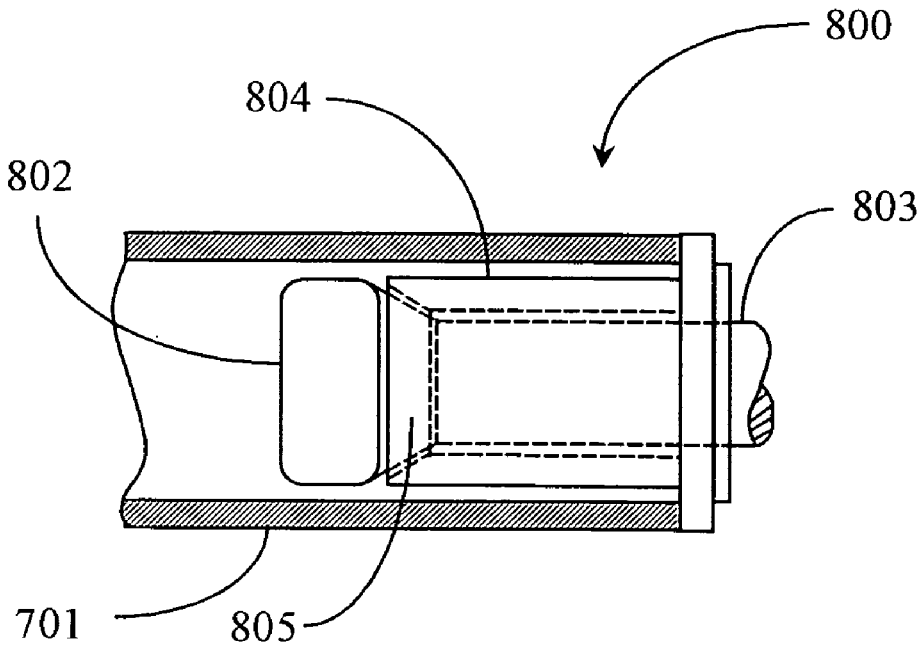
FIG. 8A is a partial elevation view of a screw stem and rubber-like sleeve component pair used in a stopper assembly and inserted into an annular opening according to another embodiment of the present invention.

FIG. 8A is a partial elevation view of a stem 802 and sleeve 804, forming pair 800, used in an open-head stopper assembly and inserted into an annular opening 701 according to another embodiment of the present invention. In FIG. 8A shows the assembly in a relaxed position such that opening 701 is not sealed.

Figure 8B:
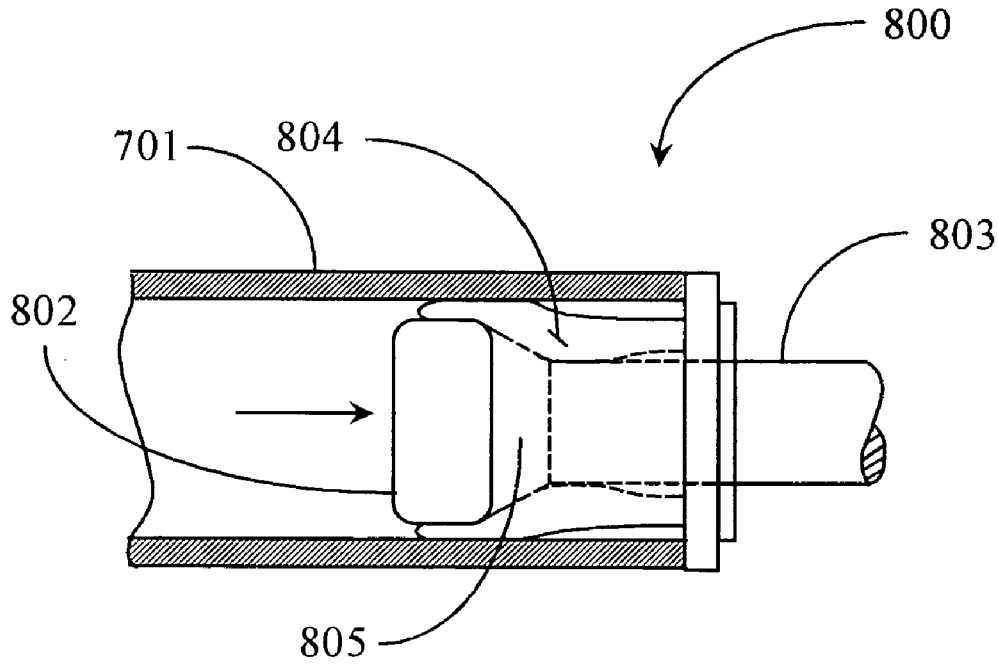
FIG. 8B is a partial elevation view of the component pair of FIG. 8A, the components actuated to seal the opening.

FIG. 8B is a partial elevation view of the component pair 800 of FIG. 8A, the components actuated to seal the opening. Referring now to FIG. 8A, component pair 800 includes an open-ended rubber sleeve 804 and a tapered head 802 of a screw stem 803.

Stem 803 is in many respects analogous to screw stem 200 described with reference to FIG. 2A, except for absence of the neck or waist feature (201) for retaining socket 205. This embodiment more closely resembles the principle described with respect to FIG. 1 wherein an open-ended rubber sleeve is used instead of a closed rubber socket. The rest of the stopper assembly as described with respect to FIGS. 7A, 7B, and previous component drawings is essentially the same.

Sleeve 804 is open-ended and has an outward tapered end that interfaces with the tapered portion 805 of head 802. The tapered portion 805 of head 802 extends to a shank portion of stem 803, which is of the same diameter including the threaded portion of stem 803. This configuration is referred to as an open-head stopper because rubber does not completely cover the stem as in the closed head stopper assembly. The stopper assembly is inserted into vessel opening 701 in the same fashion as was described above. Sleeve 804 has an overall diameter slightly smaller than the inside diameter of opening 701 to allow for easy insertion therein. The outside diameter of head 802 is also slightly smaller than the inside diameter of opening 701 or the outside diameter of sleeve 804.

Referring now to FIG. 8B, when a turning nut is turned in the correct direction, then tapered head 802 is withdrawn into sleeve 804 forcing the tapered surfaces (805) together. As travel increases the tapered end of sleeve 804 expands radially outwardly and makes peripheral contact with the inner surface of opening 701. A clearance space between the outer surface of head 802 and the inner surface of opening 701 provides a gap into which the deformed rubber flows, sealing the gap. The clearance space is small enough to ensure that the rubber does not flow freely without achieving a strong seal against the inner wall of the opening. A gripper cup and retention cap as previously described retains sleeve 804. In this embodiment a stop nut may also be provided to the threaded portion of stem 803 to avoid over tightening or dropping out of the stem, as described above.

Figure 8C:
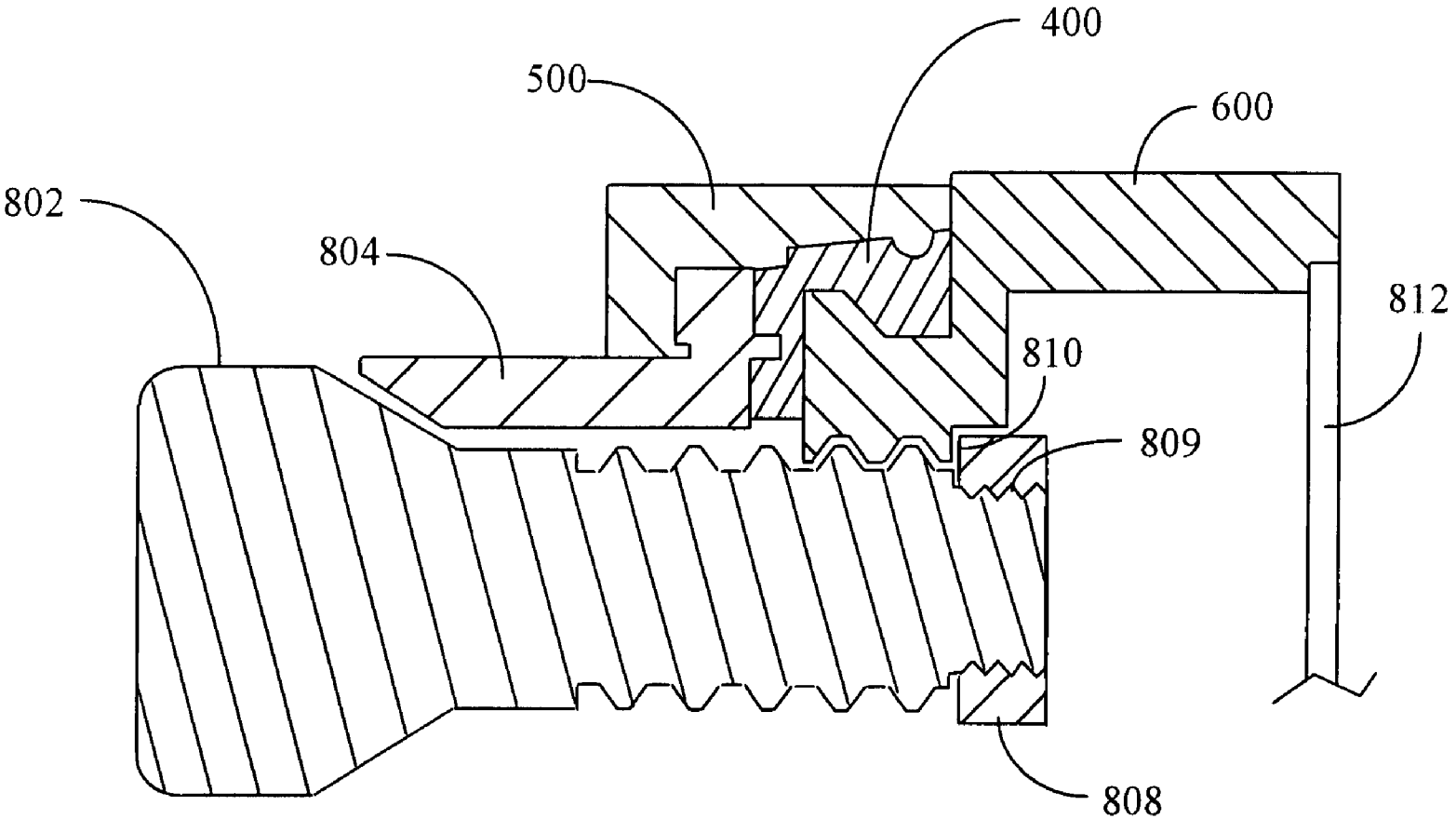
FIG. 8C is a partial section view of a stopper assembly according to an embodiment of the present invention.

FIG. 8C is a partial section view of a stopper assembly using an open stopper as described above with reference to FIGS. 8A and 8B. In this embodiment stem 802 has a second threaded portion 809 for a stop nut 808, which is tightened against a shoulder 810. The assembly in FIG. 8C is shown in a position that open-ended stopper 804 is not expanded to seal against the inside of an opening. Open-ended stopper 804 is constrained in the assembly of cap 500 and gripper cup 400. As turning nut 600 is turned relative to cap 500, stem 802 is withdrawn expanding stopper 804. Stop nut 808, engaged on threaded portion 809 of stem 802, provides a shoulder against which turning nut 600 will stop, preventing run-out, that is, turning the nut completely off the stem 802. In many embodiments a snap-in cap 812 is used to close the open end of the assembly.

Figure 9:
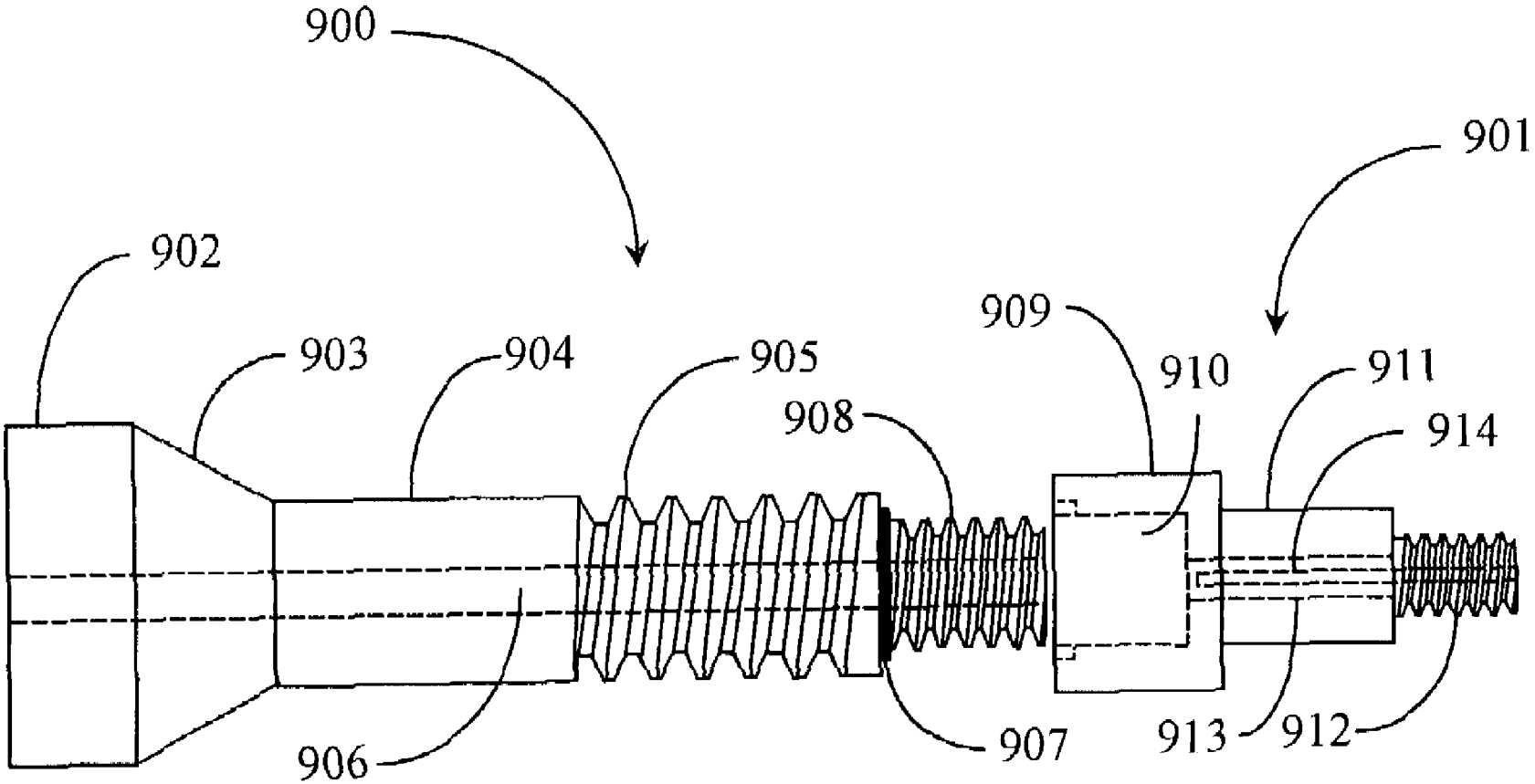
FIG. 9 is an elevation view of a screw stem and valve stem assembly used in a stopper assembly according to another embodiment of the present invention.

FIG. 9 is an elevation view of a screw stem 900 and valve stem 901 assembly used in a stopper assembly according to yet another embodiment of the present invention. Screw stem 900 has a tapered head 902 having a tapered surface 903 extending inward to a stem body 904. In this respect, stem 900 is very similar to stem 803 described with reference to FIGS. 8A and 8B. Stem body 904 has a threaded section 905, which is analogous to threaded section 202 of screw stem 200 described with reference to FIG. 2A.

On the end opposite head 902 of threaded section 905, there is a second, smaller threaded section 908, as described above with reference to FIG. 8C. Threaded section 908 has smaller and finer threads for enabling the threaded coupling of a valve stem 901 onto stem 900.

In this embodiment stem 900 has an annular passageway (bore) 906 provided through its length substantially along the longitudinal axis. Passageway 906 is adapted as a gas passageway for allowing gas to be injected into a sealed vessel without compromising the seal.

Valve stem 901 has a base 909, a stem body 911 and a threaded section 912. Base 909 has a threaded counterbore 910 provided therein at a depth and thread gage sufficient for coupling valve stem 901 to screw stem 900. When fully coupled, valve stem base 909 seals against an o-ring 907 provided to seal against leakage. Valve stem 901 has a passageway (bore) 913 provided therethrough in a longitudinal direction and centered with respect to the outer diameters of stem 901. Bore 913 is threaded to accept a standard stem valve logically illustrated herein as valve 914.

Valve stem 901 has a threaded section 912 adapted to accept a standard valve stem nozzle from a gas source such as from an air chuck of a gas source in a carbonator device. In this embodiment the valve apparatus and stem, 914 and 901 respectively are threaded together and then on to stem 900 to form an assembly that is ready to accept gas, typically carbon dioxide in one embodiment. Valve 914 is a one-way valve so that carbonation can be introduced while a seal is actuated. In this embodiment the sealing assembly is quite useful for sealing bottles and containers of different sorts for carbonating water and beverages as described in detail in the cross-referenced patent application Ser. No. 10/697,061, as, for example, FIG. 3A from that application.

The method and apparatus of the present invention provides a simple and easily operated mechanism for sealing and resealing openings of bottles or vessels using no obtrusive levers or snap wires that depend on lip features of a bottle. Moreover, the stopper assembly of the present invention can seal any opening regardless of external neck features like threading, lip features, tapers, and so on. As long as clearance between the outside of a tapered head of the screw stem and the inside wall surface of the opening is not larger than the major thickness of the rubber sleeve or stopper used than a strong airtight seal is the result.

Although specific embodiments and applications have been described in this and the parent application, it is to be understood that a variety of modifications may be made without departing from the spirit and scope of the invention. Accordingly, many different applications other than those specifically described herein may be made. There are, for example, many different ways that parts may be made to accomplish the purposes of those described herein. There are likewise many materials that may be used other than those specifically described in this specification. For these and other reasons the method and apparatus of the present invention should be afforded the broadest possible consideration in view of the presented embodiments. The spirit and scope of the present invention shall be limited only by the following claims.

What is claimed is:

1. A stopper assembly for sealing an opening of a vessel containing liquid comprising:

a screw stem body having a tapered head on one end, a threaded portion on the other end and a waist portion between the tapered head and the threaded portion having a smaller diameter than both the tapered head and the threaded portion;

an elastic enclosure fitted over at least half the length of the screw stem body including the tapered head contacting the smaller diameter of the waist portion and is thereby retained by the waist portion, such that the screw stem body is separated by the elastic enclosure from any contact with the vessel to be sealed;

a retention housing fitted to the elastic enclosure at the end opposite the tapered head, the retention housing retaining the enclosure from lateral displacement, and having a central opening through which the threaded extension passes; and a turning nut attached to the retention housing and threaded to the extension of the screw stem body on a side opposite the tapered head;

characterized in that a user inserts the stopper assembly into a vessel opening, holds the retention housing stable, and turns the turning nut causing travel of the screw stem body through the retention housing within the elastic enclosure and deformation of the elastic enclosure by the tapered head, deformation thereof directed radially outward from an area of the waist portion to make peripheral contact with an inner surface of the opening thereby sealing the opening and preventing any liquid from escaping the vessel.

2. The assembly of claim 1 wherein the elastic enclosure is a rubber socket covering the tapered head, the socket having a formed feature of peripheral orientation in the socket wall and deformation occurs when the tapered surface of the tapered head is forced against the formed feature of the socket.

3. The assembly of claim 1 wherein the retention housing is keyed to the threaded portion of the screw stem body using a key held in a key opening on the housing, the key engaging a key slot in the body to prevent rotation of the housing about the body.

4. The assembly of claim 1 wherein the retention housing includes a retention cap and a gripping cup, the cup gripping the inner surface of the retention cap to prevent inter-rotation of the components.

5. The assembly of claim 1 further comprising:

a gas passageway extending longitudinally through the screw stem body;

a second threaded portion on the body; and a valve stem assembly threaded onto the second threaded portion;

characterized in that gas is inserted into the vessel by way of the valve stem assembly and passageway through the sealed opening to maintain carbonation of liquid held in the vessel.

6. The assembly of claim 1 wherein the retention housing is keyed to the threaded portion of the screw stem body using a key engaging a key slot in the body to prevent rotation of the housing about the body.

7. The assembly of claim 1 wherein the retention housing includes a retention cap and a gripping cup the cup gripping the inner surface of the retention cap to prevent inter-rotation of the components.

8. A method for sealing a vessel containing liquid and having an opening using a stopper assembly having a threaded screw stem body with a tapered head on one end and a threaded portion on the other end and a waist portion between the tapered head and the threaded portion having a smaller diameter than both the tapered head and the threaded portion;

an elastic enclosure fitted over at least half the length of the screw stem body including the tapered head contacting the smaller diameter of the waist portion and is thereby retained by the waist portion, such that the screw stem body is separated by the elastic enclosure from any contact with the vessel to be sealed; a retention housing fitted to the elastic enclosure at and end opposite the tapered head; and a turning nut attached to the retention housing and threaded to the extension of the screw stem body comprising steps of:

(a) positioning the stopper assembly into the vessel opening;

(b) holding the retention housing to stabilize body travel there through; and (c) turning the turning nut until the opening is sealed preventing liquid from escaping the vessel.

9. The method of claim 8 wherein the elastic enclosure is one of a rubber sleeve or a rubber socket.

10. The method of claim 8 wherein in step (a) the vessel opening is void of threading or lip features.

11. The method of claim 8 wherein in step (b) the retention housing functions as a travel bed for the threaded body portion.

* * * * *